US006041707A

United States Patent [19]

Petersen et al.

[11] Patent Number: 6,041,707

[45] **Date of Patent: *Mar. 28, 2000**

[54] WEB-FED ROTARY PRINTING MACHINE

[75] Inventors: Godber Petersen; Hans Fleischmann; Rainer Stamme, all of Augsburg; Josef Schneider, Diedorf, all of Germany

[73] Assignee: MAN Roland Druckmaschinen AG, Offenbach am Main, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/878,744

[22] Filed: Jun. 19, 1997

[30] Foreign Application Priority Data

Jun. 19, 1996 [DE] Germany ..... 196 24 395

[51] Int. Cl.[7] ..... B41F 13/24; B41F 5/16; B41F 5/18; B41F 5/04

[52] U.S. Cl. ..... 101/232; 101/178; 101/181; 101/219

[58] Field of Search ..... 101/181, 136, 101/137, 138, 139, 140, 143, 178, 179, 180, 152, 182, 228, 219, 183, 171, 174, 176, 177, 216, 232

[56] References Cited

U.S. PATENT DOCUMENTS

| | | | |
|---|---|---|---|
| 1,738,324 | 12/1929 | Scott | 101/181 X |
| 2,557,381 | 6/1951 | Huebner | 101/180 |
| 2,962,962 | 12/1960 | Smith . | |
| 3,605,615 | 9/1971 | Huck . | |
| 3,761,001 | 9/1973 | Bolza-Schunemann | 101/181 X |
| 4,833,990 | 5/1989 | Hirt et al. | 101/130 |
| 4,854,806 | 8/1989 | Gertsch et al. | 242/79 X |
| 4,991,503 | 2/1991 | Morner . | |
| 5,080,338 | 1/1992 | Belanger et al. . | |
| 5,813,336 | 9/1998 | Guaraldi et al. | 101/218 |

FOREIGN PATENT DOCUMENTS

| | | |
|---|---|---|
| 469 311 | 2/1992 | European Pat. Off. . |
| 667 235 | 8/1995 | European Pat. Off. . |
| 39 00 660 | 8/1991 | Germany . |
| 195 15 459 | 10/1996 | Germany . |
| 1 991 539 | 5/1968 | Netherlands . |
| 91 028023 | 2/1990 | U.S.S.R. . |

*Primary Examiner*—Kimberly Asher
*Attorney, Agent, or Firm*—Cohen, Pontani, Lieberman & Pavane

[57] ABSTRACT

A web-fed rotary printing machine having a plurality of directly adjacent printing units. Each of the printing units has only one side wall, in which the printing group cylinders are float mounted. The printing units are arranged in-line with no working space between them.

3 Claims, 6 Drawing Sheets

WEB-FED ROTARY PRINTING MACHINE

BACKGROUND OF THE INVENTION

1. Field of the Invention

The invention relates to a web-fed rotary printing machine.

2. Description of the Prior Art

In web-fed rotary printing machines, a certain number of printing units, depending on the desired machine configuration, are set up next to each other. This is known, for example, from German reference DE 39 00 660 C2. Each printing unit has an operator-side side wall and a drive-side side wall, in which the cylinders of the printing groups are mounted. To permit maintenance and service, e.g., cleaning the inking unit or inserting the web, the printing units are located far apart. The printing machine therefore requires a great deal of space. Furthermore, the structural length of the printing machine is enlarged by aggregates arranged in front of and behind it, such as unwinding devices, driers, cooling devices and folding apparatus.

SUMMARY OF THE INVENTION

It is an object of the present invention to provide a web-fed rotary printing machine that requires little space but nonetheless offers a sufficiently accessibility for maintenance.

Pursuant to this object, and others which will become apparent hereafter, one aspect of the present invention resides in a web-fed rotary printing machine having at least two printing units arranged in-line and directly adjacent one another without working space therebetween. Each of the printing units has at least one printing group and a single side wall. The at least one printing group includes cylinders float-mounted in the side wall.

The printing machine dispenses with the operator area usually located between the printing units, and is therefore short in structure. Nonetheless, thanks to the absence of an operator-side side wall, the machine is easy to service from the side. For example, the web can be quickly inserted on various paths to produce different printed products. The printing machine is compact and economical and, because of its modular nature, its setup can be easily varied. The printing machine is also economical to operate, thanks to short conversion times.

The printing group can be configured to carry out any one of offset printing, direct gravure printing, indirect gravure printing and ferroelectric printing.

In another embodiment of the invention the printing group includes a printing form created in the printing machine.

Yet another embodiment of the inventive printing machine includes at least two winding devices associated with the at least two printing units. One of the winding devices is configured as an unwinding unit and the other of the winding devices is configured as a winding-up unit. The winding devices are arranged below the printing units in another embodiment of the invention.

In still another embodiment the winding devices are configured to be selectively driveable unwinding devices and winding-up devices.

An additional embodiment of the invention provides a roll storage device and a conveyance system that operatively connects the roll storage device with the winding devices. The roll storage device, in one embodiment, includes two horizontally guided rotated chains arranged next to one another, and trays attached to the chains so as to hold the winding rolls.

In still a further embodiment of the invention a further processing device is arranged downstream of the printing units, in a web-feed direction. The processing device can be a folding apparatus or a sheet delivery device, for example.

In yet another embodiment of the invention at least one of the printing units is provided with guide rolls arranged to selectively guide a web to one of a next printing unit, the further processing device and a winding device.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
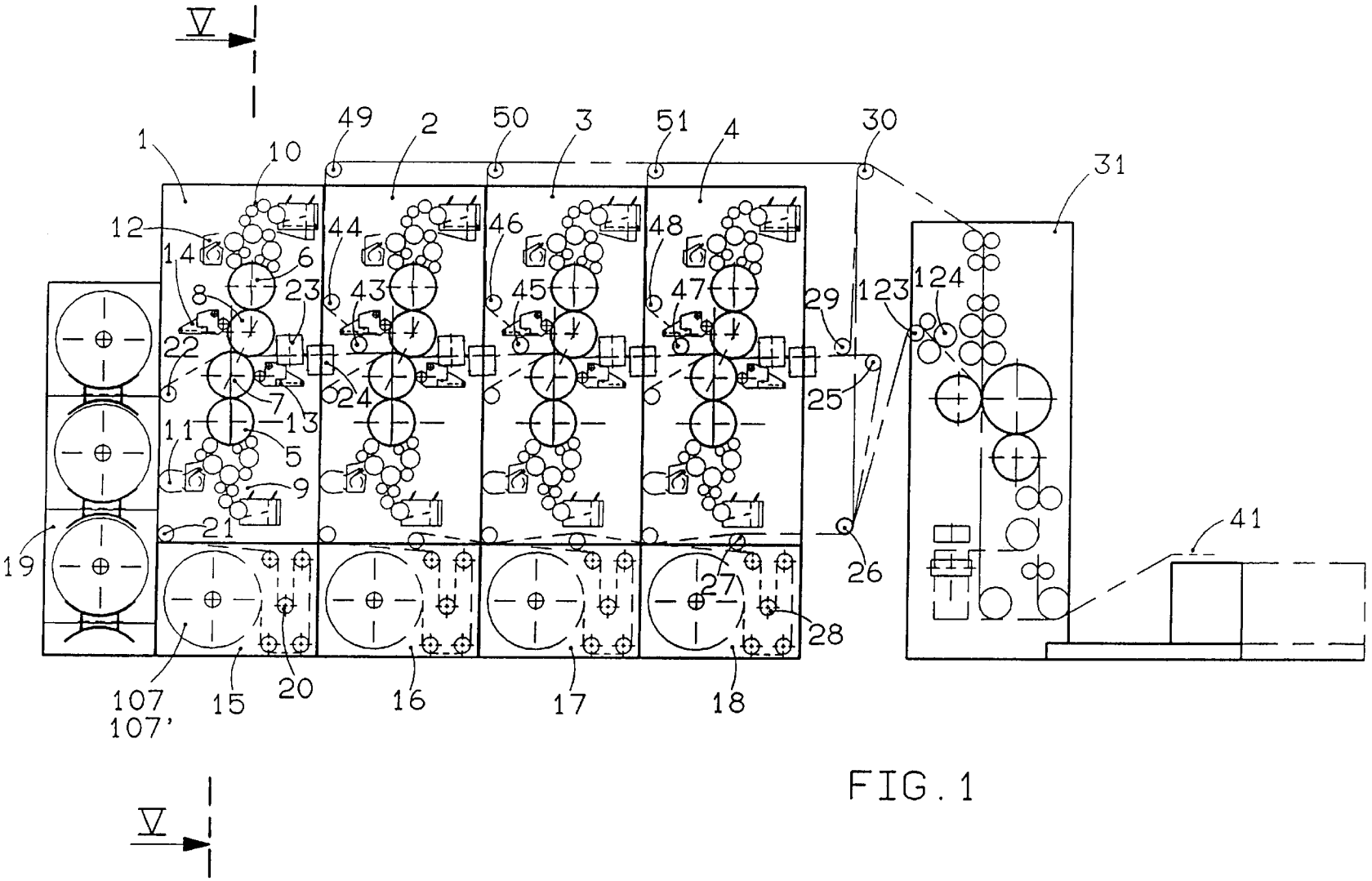
FIG. 1 schematically illustrates a printing machine for offset printing.

The offset rotary printing machine shown in FIG. 1 contains four printing units 1–4. Each printing unit 1–4 contains two printing groups, which interact according to the blanket-to-blanket method. Basically, each printing unit 1–4 contains two form cylinders 5, 6, two transfer cylinders 7, 8, inking units 9, 10, wetting units 11, 12, and rubber blanket cleaning devices 13, 14.

Figure 5:
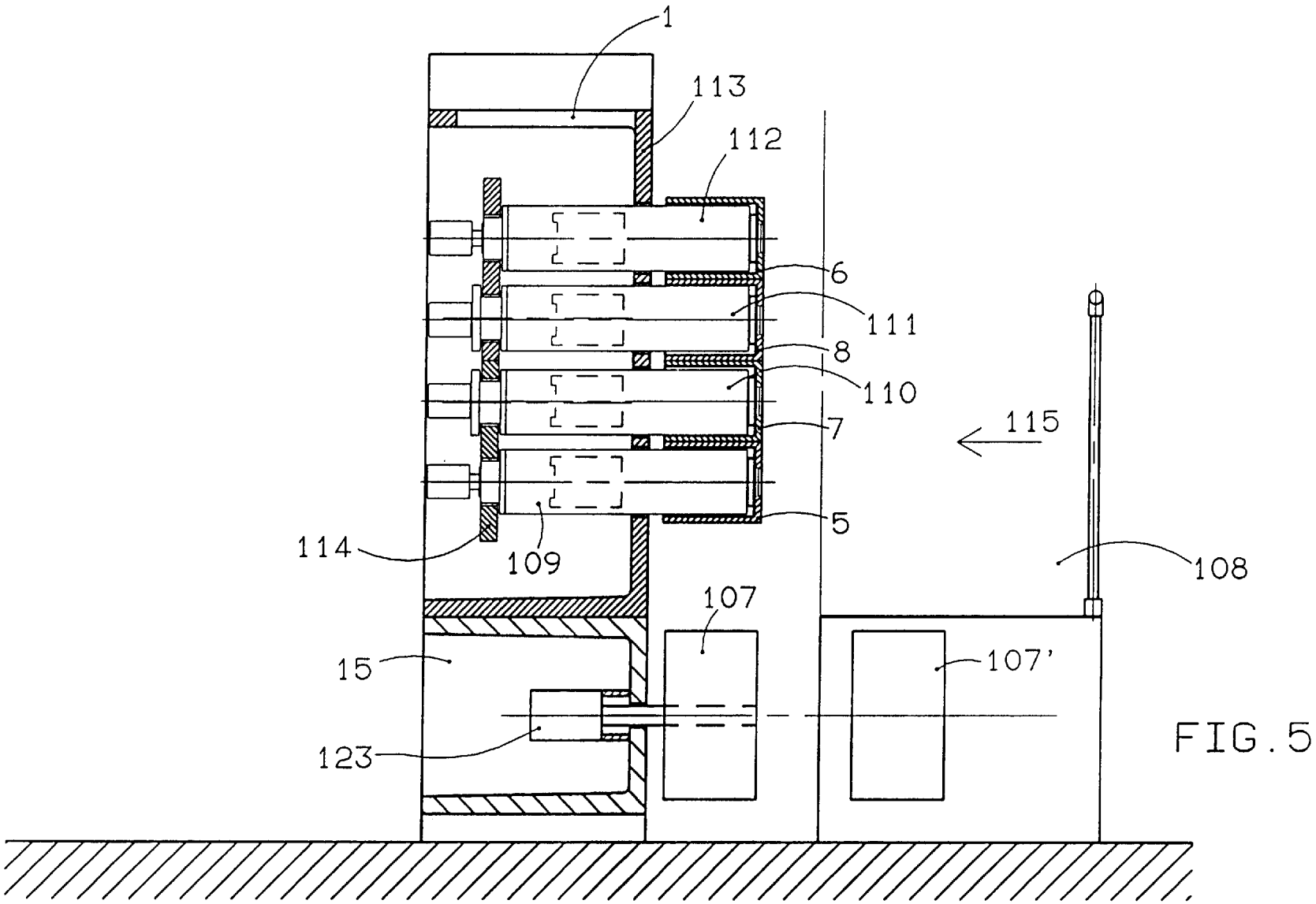
FIG. 5 is a section along the line V—V in FIG. 1.

The printing units 1–4 are arranged in-line with no space or working room between them. Below the printing units 1–4 are winding devices 15–18, each of which holds one floatmounted winding roll 107 (FIG. 5). The winding rolls 107 can also be accommodated between two levers, which are pivoted away prior to the introduction of a new winding roll 107 into the winding device 15–18. Depending on the control of their motor 123, the winding devices 15–18 can be used as either unwinding or winding-up devices.

For the sake of clarity, identical structural elements in the printing units 2–4 and the winding devices 15–18 are labelled only when necessary to distinguish them. In addition, previous item numbers are maintained for structurally identical components in the following examples.

The printing machine is accompanied by a roll storage device 19, described below, and by a folding apparatus 31.

The winding device 15 is used as an unwinding device. The web to be printed is unwound from the winding roll 107 and runs via a web edge control device 20 and guide rolls 21, 22 through the printing units 1–4 , where it is printed in four colors on both sides. After each printing, the web is dried by driers 23, 24 located in each of the printing units 1–4 . The printed web (the possible courses of the web are shown in dashed lines) is deflected at guide rolls 25–27 and fed via a web edge control device 28 to the winding device 18, which serves as a winding-up device. This process can be continued in such a way that the winding devices 16, 17 also serve as winding-up devices and thus as storage devices for printed webs. The storage capacity of these winding-up devices is thereby matched to that of the unwinding device. In a final step for a particular finished product, e.g., a newspaper, the printed web, together with the stored webs from the winding devices 16–18, can be fed via guide rolls 29, 30 to the folding apparatus 31, where multi-paged finished products are formed. The folding apparatus 31 also has, in a known (and therefore not shown) manner, a trimming device, feed roll pairs, a cross-cutting device, a cross-perforation device, a volume cylinder, a collection cylinder, a folding flap cylinder and a cross-cutter for folded products. The finished products can be stacked in a stacking device 41. Using an additional longitudinal folding device, an additional fold can be applied, offset by 90° relative to the original fold direction, e.g., for A5 products. With the help of a feed roll pair 123 and a cross-cutting device 124, envelopes can also be fed from the unwinding device 18. Furthermore, instead of being fed into a folding apparatus 31, the webs can be fed to a flat-sheet delivery device and then processed into simple cross-cut printed sheets.

As FIG. 1 shows, the printed web can also, of course, be directed to the winding devices 16–18 via the guide rolls 29, 30 immediately, without storage, and then processed into a thin finished product in the folding apparatus 31.

FIG. 1 also shows that for the purpose of four-web single-color printing, all of the winding devices 15–18 can be used as unwinding devices. In this case, the winding devices 15–18 are equipped with the winding rolls to be printed. Each winding device 15–18 is associated with a printing unit 1–4 . The webs printed in one color on both sides are fed around guide rolls 43, 44, 49 to first printing unit, guide rolls 45, 46, 50 to the second printing unit, guide rolls 47, 48, 51 to the third printing unit and, finally, the guide rolls 29, 30 to the fourth printing unit, and are processed together in the folding apparatus 31.

Figure 2:
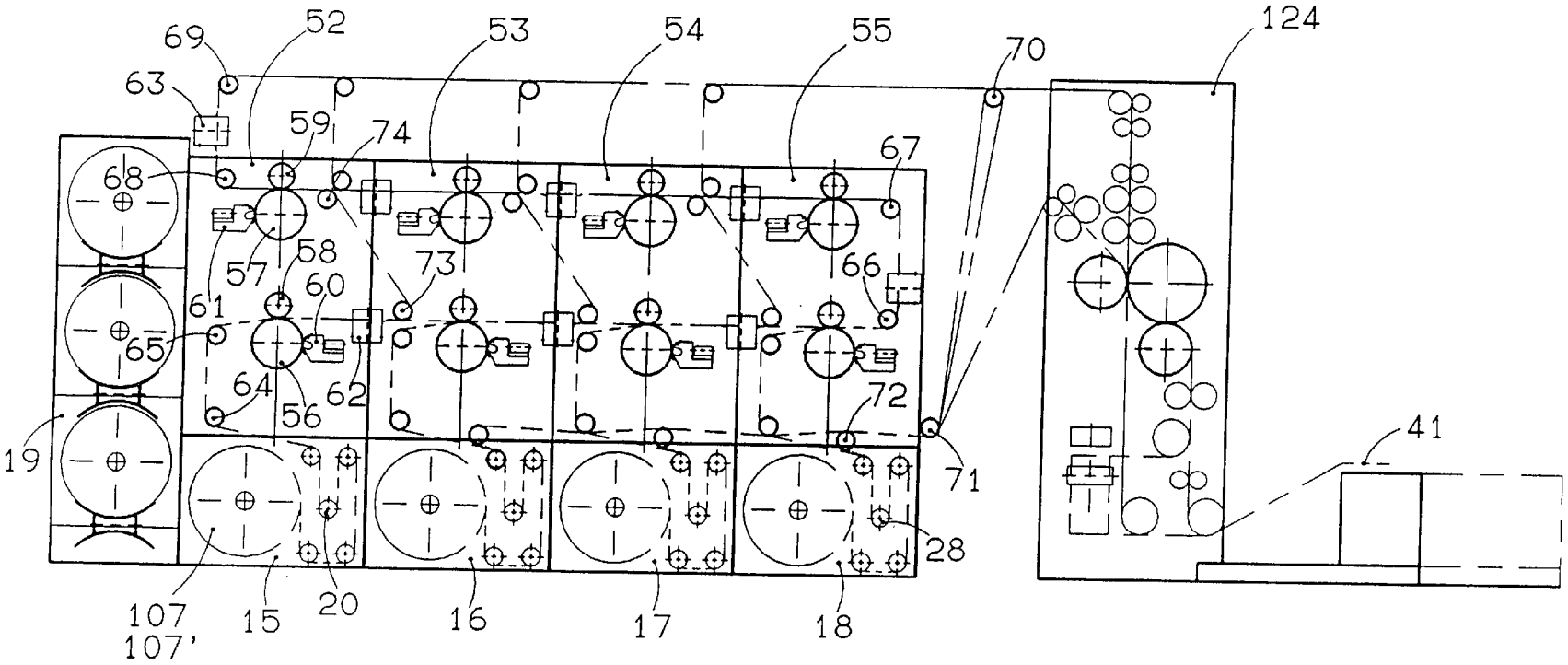
FIG. 2 shows a printing machine for direct gravure printing.

FIG. 2 shows a web-fed rotary printing machine for direct gravure printing. The printing machine contains four in-line printing units 52–55, winding devices 15–18, the roll storage device 19 and a further processing device, here, a flat-sheet delivery device 124 with the downstream stacking device 41. Each printing unit has two gravure printing groups, each of which has a form cylinder 56, 57, an impression cylinder 58, 59 and a chamber blade 60, 61. Driers 62, 63 located behind each printing group are responsible for drying the web. To achieve four-color printing on both sides, for example, the web is first fed from the winding device 15 via guide rolls 64, 65 through the lower printing groups of the printing units 52–55 for four-color first-form printing. The web is then fed via the guide rolls 66, 67 through the upper printing groups for four-color perfecting printing. After this, the web is fed via guide rolls 68, 69, 70 to the flat-sheet delivery device 124. However, as in the printing machine in FIG. 1, the web printed on both sides in four colors can also be fed via guide rolls 70, 71, 72 to the winding device 18 and wound up. As a result, this unit also offers the production options of the printing machine in FIG. 1. For example, four-web production with single-color printing on both sides is possible. For this purpose, the web in the printing unit 52, after first-form printing, is fed via the drier 62 around guide rolls 73, 74 to perfecting printing and then deflected via the guide roll 68 through the drier 63. The web is then fed via the guide roll 69, together with the other webs, to the flat-sheet delivery device 124. These other webs are fed and printed in the printing units 53–55 in the same manner as in printing unit 52.

Figure 3:
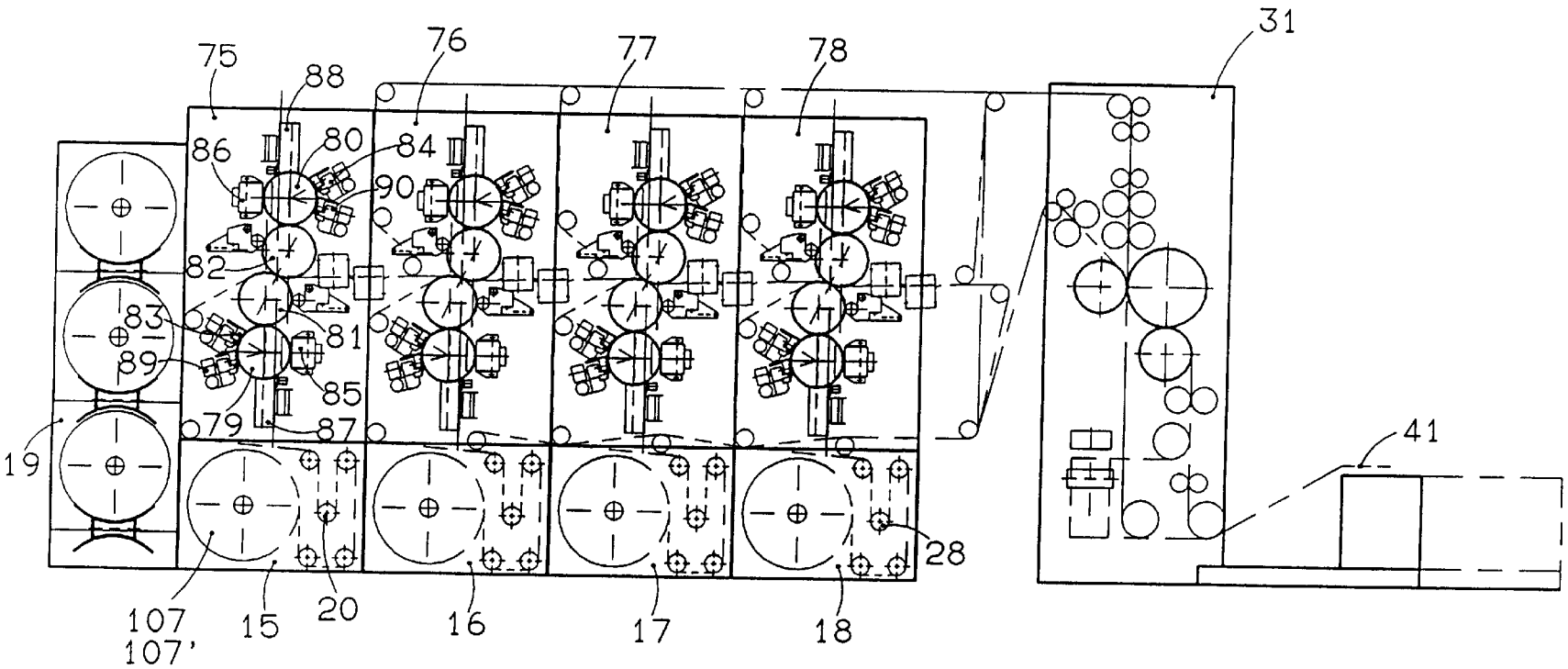
FIG. 3 shows a printing machine for indirect computer-to-press gravure printing.

FIG. 3 shows a web-fed rotary printing machine similar to that in FIG. 1, but with the difference that the printing machine in FIG. 3 is intended for indirect gravure printing in conjunction with computer-to-press technology. The printing units 75–78 have the same arrangement of form cylinders 79, 80 and transfer cylinders 81, 82 as the offset printing units in FIG. 1. However, the printing groups in this case are equipped with computer-to-press UV technology, as described in German reference DE 196 24 441.2. This technology permits especially simple servicing and short conversion times. The printing machine is connected directly to a data network via a preceding intermediate stage. As described in the aforementioned reference, each printing group has a filling chamber blade 83, 84, which serves to fill the gravure printing cups with solidifiable polymer. The applied polymer is then solidified by the UV driers 85, 86. After this, the form cylinders 79, 80 are directly imaged by means of laser heads 87, 88 via the preceding stage. Then, once the filling chamber blades 83, 84 are moved away from the cylinder surface, immediately after inking by means of chamber blades 89, 90, printing is carried out using the indirect gravure process. Advantageous chamber blades for this purpose are described in German reference DE 196 24 440.4, and will not be dealt with in detail here. The web guidance, storage and processing options correspond to those of the printing machine in FIG. 1.

Figure 4:
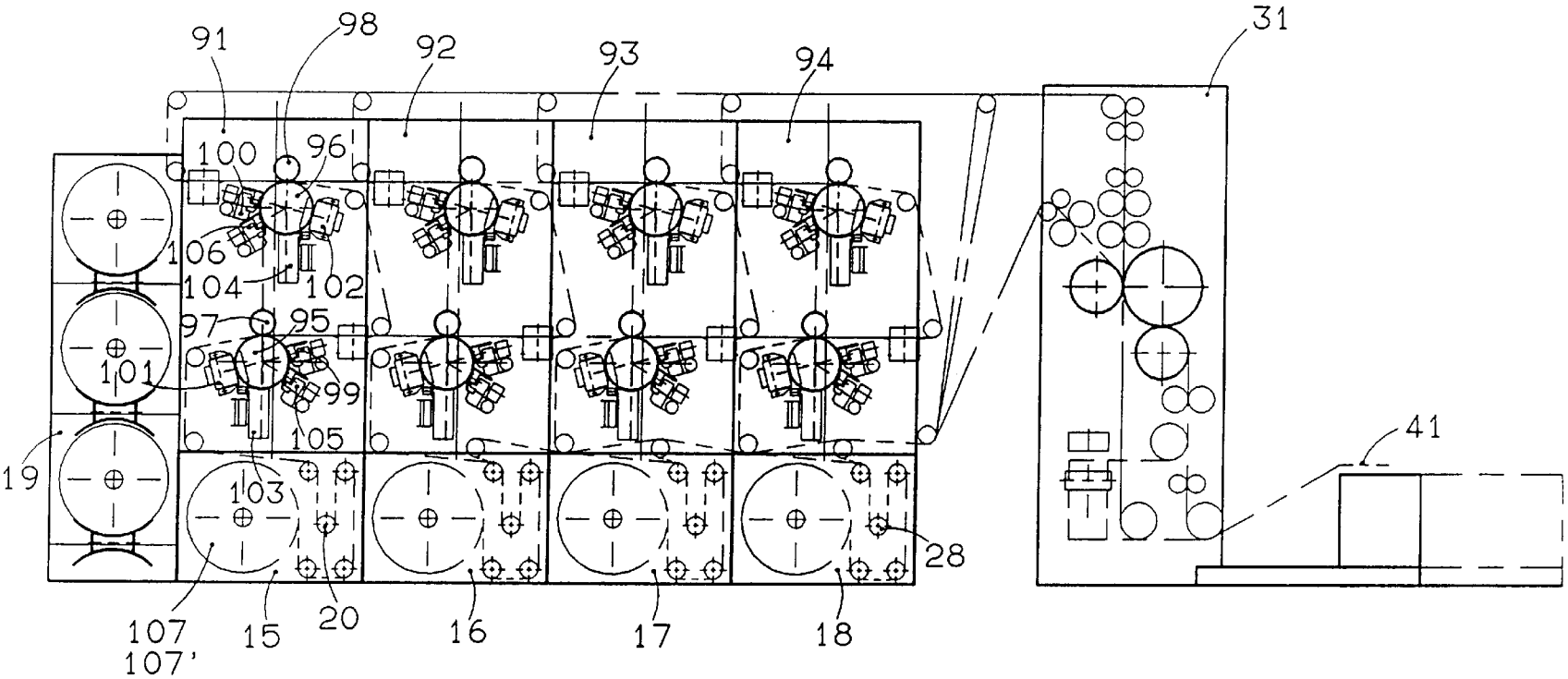
FIG. 4 shows a printing machine for direct computer-to-press gravure printing.

FIG. 4 shows a web-fed rotary printing machine for direct gravure printing. In structure, this printing machine resembles the printing machine in FIG. 2, containing four printing units 91–94, each with two gravure printing groups with form cylinders 95, 96 and impression cylinders 97, 98. The printing groups are also equipped with elements for computer-to-press gravure UV technology, thus offering special advantages for short conversion times and simple service. Thus, the printing units 91–94 have filling chamber blades 99, 100, UV driers 101, 102 and laser heads 103, 104 for the production of printing forms. After printing form production, printing can be carried out by means of chamber blades 105, 106. The web guidance and production options correspond to those of the printing machine in FIG. 2.

FIG. 5 shows a cross-section through the machine base in the region of the printing units (Section V—V of FIG. 1). The machine base is the same for all of the printing machines described above. The printing group 1 is attached to the winding device 15. The float mounting of the motor spindles 109–112, which are supported in a side wall 113 and an auxiliary wall 114, is characteristic. These motor spindles 109–112 are described in detail in German reference DE 196 24394.7, and are thus generally known. The form cylinders 5, 6 and the transfer cylinders 7, 8 are placed on the motor spindles 109–112.

Because there is no second side wall and because a float mounting is used, all machine parts and servicing elements of the printing machines remain freely and easily accessible in the servicing region 108, 115 at web widths up to approximately 1 m. It is also possible to embody various elements in such a way that they can be removed from the region of the printing group cylinders for maintenance. The result is short conversion times, which can be further reduced by the use of computer-to-press technology. The described printing machines therefore also offer printing of small runs and at decentralized printing sites. Moreover, the flexibility of the printing machines (web guidance variants) supports such applications, as does the option of producing finished products.

The machine can also be operated by one person. The compact structure of the printing machine makes its setup possible even under cramped space conditions.

In addition to the above-described embodiments, many other possible machine configurations exist. For example, printing units can contain only one printing group; e.g., the printing unit 52 in FIG. 2 can contain only the printing group consisting of the form cylinder 56 and the impression cylinder 58. Furthermore, the printing unit 1 from FIG. 1 may contain only a single offset printing group; in this case, instead of the upper printing unit, only one counterpressure cylinder is present, which interacts with the transfer cylinder 7. Similarly, other printing methods can be used, e.g., printing with ferroelectric ceramics. In addition, the number of printing units can differ from the four selected in the examples. For instance, in the printing machine in FIG. 4, the printing units 93, 94 can be omitted and the printing units 91, 92 can each contain only one gravure printing group. Furthermore, use of only two winding devices 15, 16, with one winding device 15 acting as the unwinding device and one winding device 16 acting as the winding-up device is possible. Using a rotary printing machine of this type, it is possible for a web to be printed in one-color or two-color first-form printing and then further processed in the folding apparatus 31 or the flat-sheet delivery device 124 or wound up in the winding device 15. In the latter case, the winding roll is then transferred into the winding device 15 and its web is printed with two-color perfecting printing during a further passage through the printing units 91, 92, or else the existing two-color first-form printing is supplemented to four-color printing. If a further processing device is used, a choice can be made between the folding apparatus 31 and the flat-sheet delivery device 124.

Figure 7:
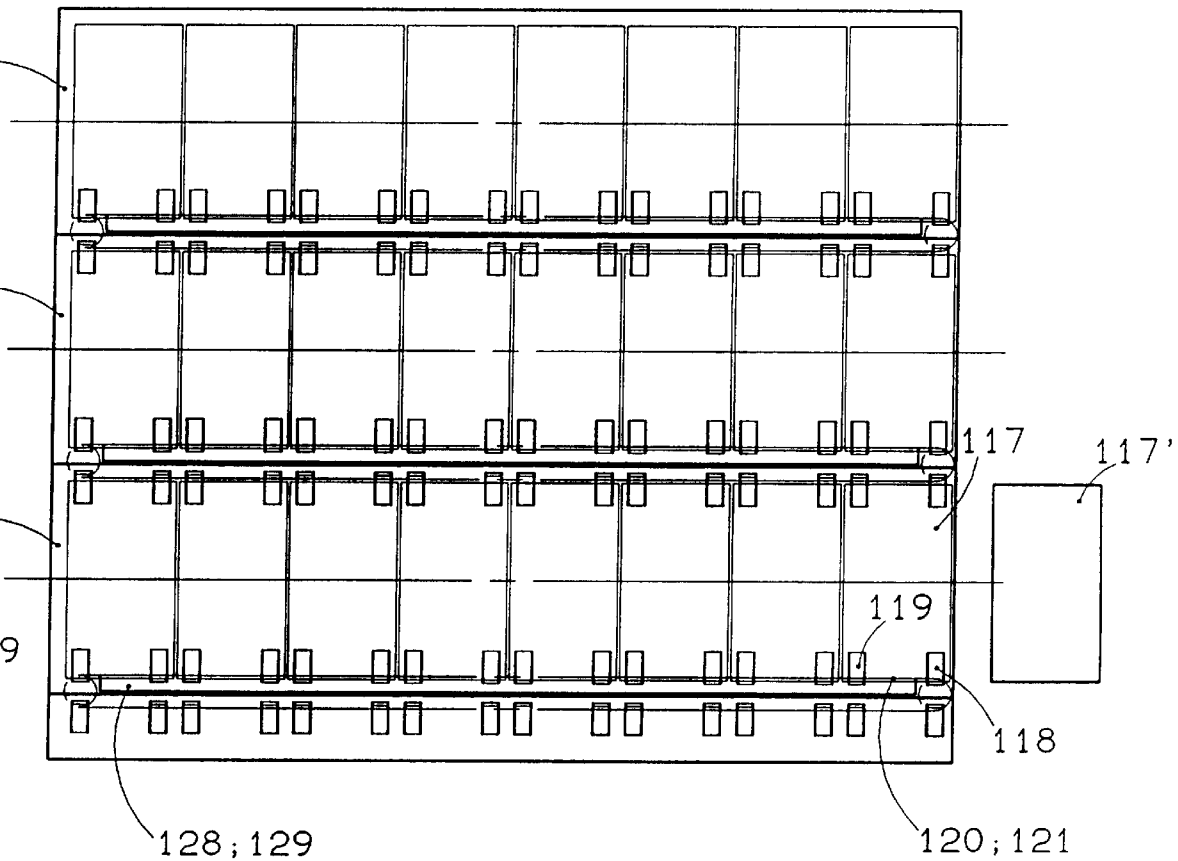
FIG. 7 is a view in the direction VII in FIG. 6.
Figure 6:
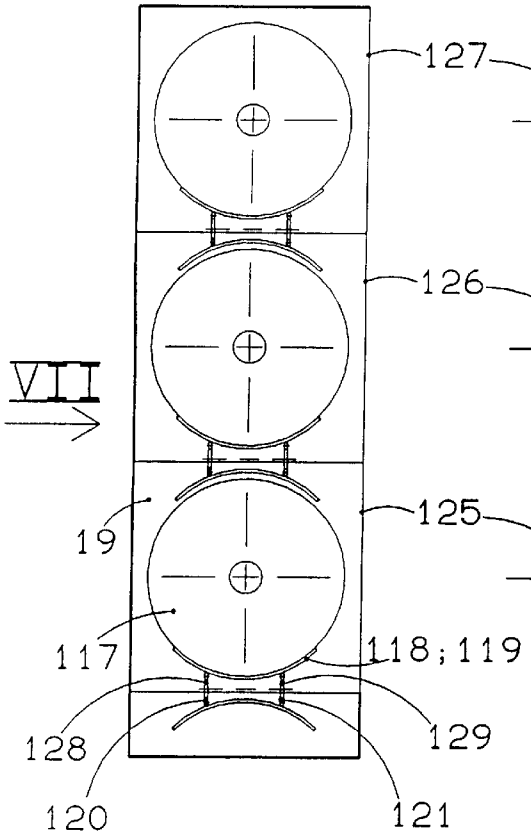
FIG. 6 is a side view of a roll storage device.

FIGS. 6 and 7 show a roll storage device 19, with which the described printing machines are advantageously complemented. The roll storage device 19 is connected to a conveyance system (not shown) with the winding devices 15–18. This conveyance system serves to load the winding devices 15–18, i.e., to convey the winding roll 107' (FIG. 5) into the winding device 15 (reference item 107) and vice versa. The conveyance system also serves to remove the winding rolls 117 from the roll storage device 19 and to load winding rolls 117' into the roll storage device 19. The storage device 19 is also able to store printed winding rolls 117.

The roll storage device 19 contains several storage devices 125–127 arranged one atop the other. As a result, space can be used in its height as well as its depth, so that the storage devices can be well-adapted optically to the printing machine. Each storage device 125, 126, 127 has two horizontally guided rotating chains 120, 121 arranged one next to the other, to which are attached trays 118, 119 for holding a winding roll 117. The upper strands of the chains 120, 121 are supported by a bar 128, 129.

The invention is not limited by the embodiments described above which are presented as examples only but can be modified in various ways within the scope of protection defined by the appended patent claims.

We claim:

1. A web-fed rotary printing machine comprising:

at least two printing units arranged in-line and directly, horizontally adjacent one another without working space therebetween, each of the printing units having a single sidewall and at least one printing group, the at least one printing group of each printing unit having cylinders mounted in the single sidewall in a cantilevered manner;

at least two winding devices associated with the at least two printing units, one of the winding devices being an unwinding device and another of the winding devices being a winding-up device, the printing units being mounted on the winding devices so that the winding devices are arranged below the printing units, each of the winding devices including a cantilevered winding roll; and a processing device arranged downstream of the printing units in a web-feed direction, the printing units, the winding devices and the processing device being operatively connected together in a modular manner.

2. A web-fed rotary printing machine as defined in claim 1, wherein the process devices are folding apparatus.

3. A web-fed rotary printing machine as defined in claim 1, wherein the processing device is a sheet delivery device.

* * * * *